US006729282B2

(12) United States Patent
Sugawara

(10) Patent No.: US 6,729,282 B2
(45) Date of Patent: May 4, 2004

(54) VARIABLE VALVE LIFT DEVICE

(75) Inventor: Masafumi Sugawara, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/093,408

(22) Filed: Mar. 11, 2002

(65) Prior Publication Data

US 2003/0047154 A1 Mar. 13, 2003

(30) Foreign Application Priority Data

Sep. 10, 2001 (JP) ..... 2001-273939

(51) Int. Cl.[7] ..... F01L 1/34

(52) U.S. Cl. ..... 123/90.16; 123/90.15; 123/90.48; 74/569

(58) Field of Search ..... 123/90.12, 90.15, 123/90.16, 90.48, 90.49, 90.5, 90.51, 90.52, 90.53, 90.54, 90.55, 90.56, 90.57, 90.58, 90.59; 74/569

(56) References Cited

U.S. PATENT DOCUMENTS 5,398,648 A * 3/1995 Spath et al. ..... 123/90.16
5,709,180 A * 1/1998 Spath ..... 123/90.16
6,085,704 A * 7/2000 Hara ..... 123/90.11
2001/0030090 A1 * 10/2001 Thomas et al. ..... 188/72.9

FOREIGN PATENT DOCUMENTS

| | | |
|---|---|---|
| DE | 1958627 | 7/1971 |
| JP | 7-119426 | 5/1995 |
| JP | 2563713 | 9/1996 |

* cited by examiner

*Primary Examiner*—Thomas Denion
*Assistant Examiner*—Jaime Corrigan
(74) *Attorney, Agent, or Firm*—Sughrue Mion, PLLC

(57) ABSTRACT

A variable valve lift device according to the present invention includes a tappet case, a sway member and a sliding member. The tappet case makes contact with one of cams arranged at a camshaft driven rotationally due to a crankshaft of an internal combustion engine and which is driven reciprocally due to the rotation of the cam. The sway member is so supported in the tappet case as to allow sway of the sway member and has a sliding face displacing a valve stem in an axial direction of the valve stem. The sliding member is so arranged in the tappet case as to allow sliding of the sliding member and sways the sway member when the sliding member is slid.

15 Claims, 13 Drawing Sheets

VARIABLE VALVE LIFT DEVICE

BACKGROUND OF THE INVENTION

1. Field of the Invention

The present invention relates to a variable valve lift device used for a direct drive-style valve driving system driving directly an intake or exhaust valve (hereafter, referred as a valve) using a cam when the valve of an internal combustion engine (hereafter, referred as an engine) is opened and closed. The variable valve lift device (hereafter, referred as a VVL device) changes a length of a tappet in an axial direction to adjust a valve lift of the valve.

2. Description of the Prior Art

With a conventional rocker arm-style engine, in order to adjust the valve lift of the valve responsive to any operational status of the engine, cam-profiles arranged on a camshaft, each profile corresponding to a required valve lift, and a switching mechanism is arranged in the rocker arm. With such a constructed engine, it is necessary to arrange the plurality of cam profiles on the camshaft and accordingly to increase the cost of manufacture. It further runs counter to a request of reduction in weight.

On the other hand, in recent years, the direct drive-style engine driving directly the valve using a cam without using the rocker arm provides with the VVL device adjusting the valve lift of the valve responsive to any operational status of the engine. A known VVL device includes a tappet case arranged between the cam and the valve and a variable valve lift system built into the tappet case. Construction regarding a general direct drive-style engine and the conventional VVL device will be described in detail hereafter.

FIG. 1 is a diagrammatic sketch of direct drive-style valve driving system in the engine. FIG. 2 is a view taken in the direction of arrow A—A in FIG. 1 and showing a cam on a camshaft in the valve driving system. FIG. 3 is a front view of a cam-profile of a cam shown in FIG. 2. Here, only an intake valve driving system of the intake and exhaust valve driving systems is indicated. Since the exhaust valve driving system has the same construction as the intake valve driving system, the exhaust valve driving system is also operated by the same action as the intake valve driving system. Therefore, further description will be omitted. Moreover, assume that a cylinder shown in the drawing is arranged in a vertical direction.

In the drawings, reference numerals 1, 2, 3 and 4 denote cylinders in a four-cylinder engine. Pistons 5, 6, 7 and 8 are arranged in the respective cylinders 1, 2, 3 and 4, each reciprocating in an axial direction of each cylinder. Reciprocal movements of the pistons 5, 6, 7 and 8 are converted into rotational movements and transferred to a crankshaft 13. Two valve seats 14, 15, 16 and 17 per cylinder are arranged at an upper section (cylinder head) of the cylinders 1, 2, 3 and 4, respectively. Intake valves 18, 19, 20 and 21 are arranged at the valve seats 14, 15, 16 and 17, respectively. Rotational movements of intake cams 26, 27, 28 and 29 are transferred to the intake valves 18, 19, 20 and 21 byway of a VVL devices 22, 23, 24 and 25. The intake cams 26, 27, 28 and 29 are arranged on an intake camshaft 30. The intake camshaft 30 can be rotated in a direction of arrow B in FIG. 2 due to a rotational driving force of the crankshaft transferred to the intake camshaft 30 via a pulley 31, a driving force transferable member 32 such as timing belts, and a pulley 33.

Here, since all the intake cams 26, 27, 28 and 29 have the same construction, the intake cam 26 will be explained as a representative example. The intake cam 26 shown in FIG. 3 includes a base-circle section 26*a* having a circular-shape in cross section, a lift-curve section 26*b* protruded from the base-circle section 26*a* and two ramp sections 26*c* and 26*d* connecting smoothly the base-circle section 26*a* to the lift-curve section 26*b* and vice versa. Another intake cams 27, 28 and 29 have the construction above as in the case of the intake cam 26.

The lift-curve section 27*b* of the intake cam 27 and the lift-curve section 28*b* of the intake cam 28 are shifted plus or minus 90 degrees with respect to the lift-curve section 26*b* of the intake cam 26 in an outer periphery of the intake camshaft 30 as shown in FIG. 2. The lift-curve section 29*b* of the residual intake cam 29 is shifted approximately 180 degrees with respect to the lift-curve section 26*b* of the intake cam 26 in an outer periphery of the intake camshaft 30.

Here, since all the VVL devices 22, 23, 24 and 25 have the same construction, the VVL device 22 will be explained as a representative example. The conventional VVL device 22 has a construction as disclosed in German Patent Gazette DT1958627. The conventional VVL device 22 includes a tappet case 34 having an upper section with a cam contact section 34*a* making contact with a cam face of the intake cam 26. The device 22 includes a hydraulic cylinder (not shown) arranged in the tappet case 34 to select a high-lift mode extending the length of the tappet in the axial direction and a low-lift mode shrinking it.

A lower section of the VVL device 22 makes contact with an upper section of a valve stem 35. The intake valve 18 is mounted on a lower section of the valve stem 35. A valve spring (not shown) is arranged between the valve stem 35 and the cylinder 1 and biases upwardly the valve stem 35 in the axial direction to press the intake valve 18 against the valve seat 14 to close it.

An operation of the VVL device 22 will be explained hereafter.

First, just after the engine is started, a hydraulic pressure supplied from an oil pump (not shown) to the VVL device 22 does not yet rise to adequate levels and the hydraulic cylinder (not shown) in the VVL device 22 is not extended. Therefore, the hydraulic cylinder (not shown) is so set as to select the low-lift mode. With the low-lift mode, when the intake cam 26 rotates in the direction of arrow B in FIG. 2, the cam contact section 34*a* of the tappet case 34 makes contact with the intake cam 26 to run from the base-circle section 26*a* to the lift-curve section 26*b* via the ramp section 26*c*. However, a downward displacement of the cam contact section 34*a* in the axial direction is not yet increased. Therefore, the tappet case 34 and the valve stem 35 do not move downwardly in the axial direction. When the intake cam 26 further rotates, the cam contact section 34*a* of the tappet case 34 makes contact with the intake cam 26 to run from the ramp section 26*c* to a middle of the lift-curve section 26*b*. At this time, the downward displacement of the cam contact section 34*a* in the axial direction is increased. Therefore, the tappet case 34 and the valve stem 35 are pressed down against the biasing force of the valve spring (not shown) and the intake valve 18 also is pressed down in the axial direction with respect to the valve seat 14 (low-lift state).

Moreover, when the engine is driven usually, the hydraulic pressure supplied from an oil pump (not shown) to the VVL device 22 rises to adequate levels and the hydraulic cylinder (not shown) in the VVL device 22 is extended. Therefore, the hydraulic cylinder (not shown) is so set as to select the high-lift mode. With the high-lift mode, when the intake cam 26 rotates in the direction B in FIG. 2, the cam contact section 34*a* of the tappet case 34 makes contact with the intake cam 26 to run from the base-circle section 26*a* to the lift-curve section 26*b* in orderly sequence. However, a downward displacement of the cam contact section 34*a* in the axial direction is not yet increased. Therefore, the tappet case 34 and the valve stem 35 do not move downwardly in the axial direction. When the intake cam 26 further rotates, the cam contact section 34*a* of the tappet case 34 makes contact with the intake cam 26 to run from the base-circle section 26*a* to the lift-curve section 26*b* via the ramp section 26*c*. At this time, the downward displacement of the cam contact section 34*a* in the axial direction is increased. The tappet case 34 and the valve stem 35 are therefore pressed down against the biasing force of the valve spring (not shown) in the axial direction in accordance with the cam-profile of the lift-curve section 26*b*. As a result, the intake valve 18 also is pressed down in the axial direction with respect to the valve seat 14 (high-lift state).

However, the VVL device 22 provides with a variable valve lift system including the hydraulic cylinder (not shown) having oil paths arranged in the tappet case 34. Since the construction of the variable valve lift system is complicated, it results in increasing in mass of the system. Therefore, it becomes useless to reduce inertial mass defined as the maximum merit of the direct drive-style VVL device.

SUMMARY OF THE INVENTION

Accordingly, it is an object of the present invention to provide a VVL device which is compact and lightweight and which simplifies its internal structure.

In order to achieve the object of the present invention, we provide a variable valve lift device, comprising: a tappet case which makes contact with one of cams arranged at a camshaft driven rotationally due to a crankshaft of an internal combustion engine and which is driven reciprocally due to the rotation of the cam; a sway member which is so supported in the tappet case as to allow sway of the sway member and which has a sliding face displacing a valve stem in an axial direction of the valve stem; and a sliding member which is so arranged in the tappet case as to allow sliding of the sliding member and which sways the sway member when the sliding member is slid. In this way, since it is possible to simplify the internal structure of the tappet case, the VVL device can be reduced in size and weight. Therefore, it is possible to make full use of the reduction of inertial mass defined as the maximum merit of the direct drive-style VVL device.

With the above arrangement, the cam making contact with the tappet case may have a low-lift cam profile adequate for either one or both of driving condition of middle speed or less and middle load or less of the internal combustion engine. In this way, since the construction is applicable to a camshaft equal to a camshaft used in a normal internal combustion engine without any specialized equipment, the VVL device can be reduced in size and weight. Since the VVL device per se is not operated under the above condition, it is possible to increase the durability and the reliability of the VVL device.

With the above arrangement, the sway member may be so set as to increase displacement of an intake valve or an exhaust valve with respect to displacement of the tappet case in the axial direction under the driving condition of middle speed or more and middle load or more of the internal combustion engine. In this way, only when the engine is driven under the above condition, it is possible to operate the sway member as a second cam to increase the valve lift. Therefore, it is possible to increase the durability and the reliability of the VVL device.

With the above arrangement, the sliding member may include a fit hole which allows fit of a reciprocating external piston based on a cylinder head side of the internal combustion engine via a long aperture extending on an outer peripheral face of the tappet case in the axial direction of the tappet case; and a support section supporting a protuberance formed at a position different from a position of a lift section of the sway member which makes contact with an end of the valve stem relative to a center of rotation of the sway member in a state of fitting the external piston in the fit hole. In this way, the tappet case moves toward the valve in accordance with the cam-profile when the external piston is fitted in the fit hole of the sliding member, whereas the movement of the sliding member in the axial direction is restricted. Since the sway member moving together with the tappet case sways due to the support section, the contact section of the sway member slides on the valve stem. Therefore, it is possible to displace largely the valve stem toward the valve side in accordance with the profile of the contact section of the sway member.

With the above arrangement, a sliding face of the sliding member making contact with the valve stem may have an advantageous shape for exhibiting the same abrasion and sliding resistance properties as the cam profile. In this way, since it is possible to prevent the occurrence of an abrasion and a pinch of the sway member, it is possible to increase the durability and the reliability of the VVL device.

With the above arrangement, the sway member may have a sliding face having a shape adequate for locking the sliding member due to a load derived from the valve stem in a state of not fitting the external piston in the fit hole of the sliding member. In this way, since it is possible to prevent the occurrence of an abrasion and a pinch of the sway member, it is possible to increase the durability and the reliability of the VVL device.

With the above arrangement, two or more symmetrical sway members may be arranged in one tappet case. In this way, since it is possible to reduce the pinch occurred between the sway member and the tappet case, it is possible to increase the durability and the reliability of the VVL device.

With the above arrangement, the sway member may be made of high-strength sintered materials or materials for exhibiting abrasion and sliding resistance properties. In this way, since it is possible to increase the durability of the VVL device and to ensure the sliding resistance property between movable parts with stability over a long term, it is possible to increase the operational reliability of the VVL device.

With the above arrangement, the external piston may move forward to fit in the fit hole of the sliding member due to application of hydrodynamic pressure or electromagnetic force and may move back in a direction of unlocking the fit relation due to a mechanical biasing force when the hydrodynamic pressure or electromagnetic force is not applied. In this way, since the external piston is fitted detachably in the fit hole, it is possible to increase the reliability of operation of the VVL device.

With the above arrangement, the external piston may restrict rotation of the tappet case and the sliding member in a peripheral direction thereof and displacement in the axial direction when the external piston is fitted in the fit hole of the sliding member and restricts the rotation of the tappet case and the sliding member in the peripheral direction thereof when the fit relation is unlocked. In this way, since it is possible to locate the tappet case and the sliding member in the peripheral direction thereof at all times, it is possible to increase the durability and the reliability of the VVL device.

With the above arrangement, the long aperture of the tappet case may have a width slightly larger than an outer diameter of the external piston. In this way, since the external piston is fitted in the long aperture to restrict the rotation of the tappet case and to locate the tappet case in the peripheral direction, it is possible to increase the durability and the reliability of the VVL device.

With the above arrangement, a central axis of swaying of the sway member may be parallel to the camshaft. In this way, it is possible to reduce a pinch occurred between the sway member and the tappet case and to increase the durability and the reliability of the VVL device.

With the above arrangement, two external pistons facing to each other may be so arranged reciprocally as to be symmetrical about a central axis of one tappet case. In this way, a pinch occurred between the sliding member and the tappet case can be reduced and it is possible to increase the durability and the reliability of the VVL device.

With the above arrangement, the external piston may be made of high-strength sintered materials or materials for exhibiting abrasion and sliding resistance properties. In this way, since it is possible to increase the durability of the VVL device and to ensure the sliding resistance property between movable parts with stability over a long term, it is possible to increase the operational reliability of the VVL device.

With the above arrangement, the sliding member may be a ring-shaped member, which is so arranged in the tappet case as to slide between an uppermost section of the tappet case and a ring-shaped stopper fixed in the tappet case. In this way, the sway member making contact with the valve stem can be arranged in the tappet case and the sliding member. Therefore, since the respective parts can be arranged in such a compact space, the VVL device per se can be reduced in size and weight.

With the above arrangement, it may further comprise a drain hole arranged in the fit hole of the sliding member. In this way, it is possible to improve responsibility of the external piston.

With the above arrangement, it may further comprise a tapered section which has a width in the axial direction which is larger than a clearance defined between a base circle of the cam and an upper section of the tappet case and which is formed at an opening of the fit hole of the sliding member. In this way, even if the displacement of the sliding member in the axial direction with respect to the external piston is comparable to the clearance above or so, it is possible to lead the external piston to the fit hole of the sliding member due to the tapered section. Therefore, it is possible to ensure the quick fitting of the external piston in the fit hole of the sliding member with reliability and to improve the responsibility and the operational reliability.

With the above arrangement, the sliding member may be made of high-strength sintered materials or materials for exhibiting abrasion and sliding resistance properties. In this way, since it is possible to increase the durability of the VVL device and to ensure the sliding resistance property between movable parts with stability over a long term, it is possible to increase the operational reliability of the VVL device.

With the above arrangement, it may further comprise a recess arranged at an upper section of the tappet case to allow arrangement of a clearance adjustment member adjusting a clearance defined between a base circle of the cam and an upper section of the tappet case, and may further comprise a bearing arranged integrally in the tappet case to support a sway axis of the sway member. In this way, when the internal combustion engine is assembled and fabricated, the clearance adjustment member having a thickness corresponding to a measured value of the clearance can be arranged as appropriate. Since the bearing for the sway axis of the sway member is arranged integrally in the tappet case, it is possible to reduce a component count to make an assembling work more efficient and to reduce the cost of parts.

With the above arrangement, it may further comprise a disk-shaped clearance adjustment member arranged between the sway member and the valve stem. In this way, it is possible to enlarge an area of abutment against the sway member and to adjust the clearance defined between the base circle of the cam and the upper section of the tappet case.

DESCRIPTION OF THE PREFERRED EMBODIMENT OF THE INVENTION

Embodiments of the present invention will be hereafter explained.

Embodiment 1

Figure 1:
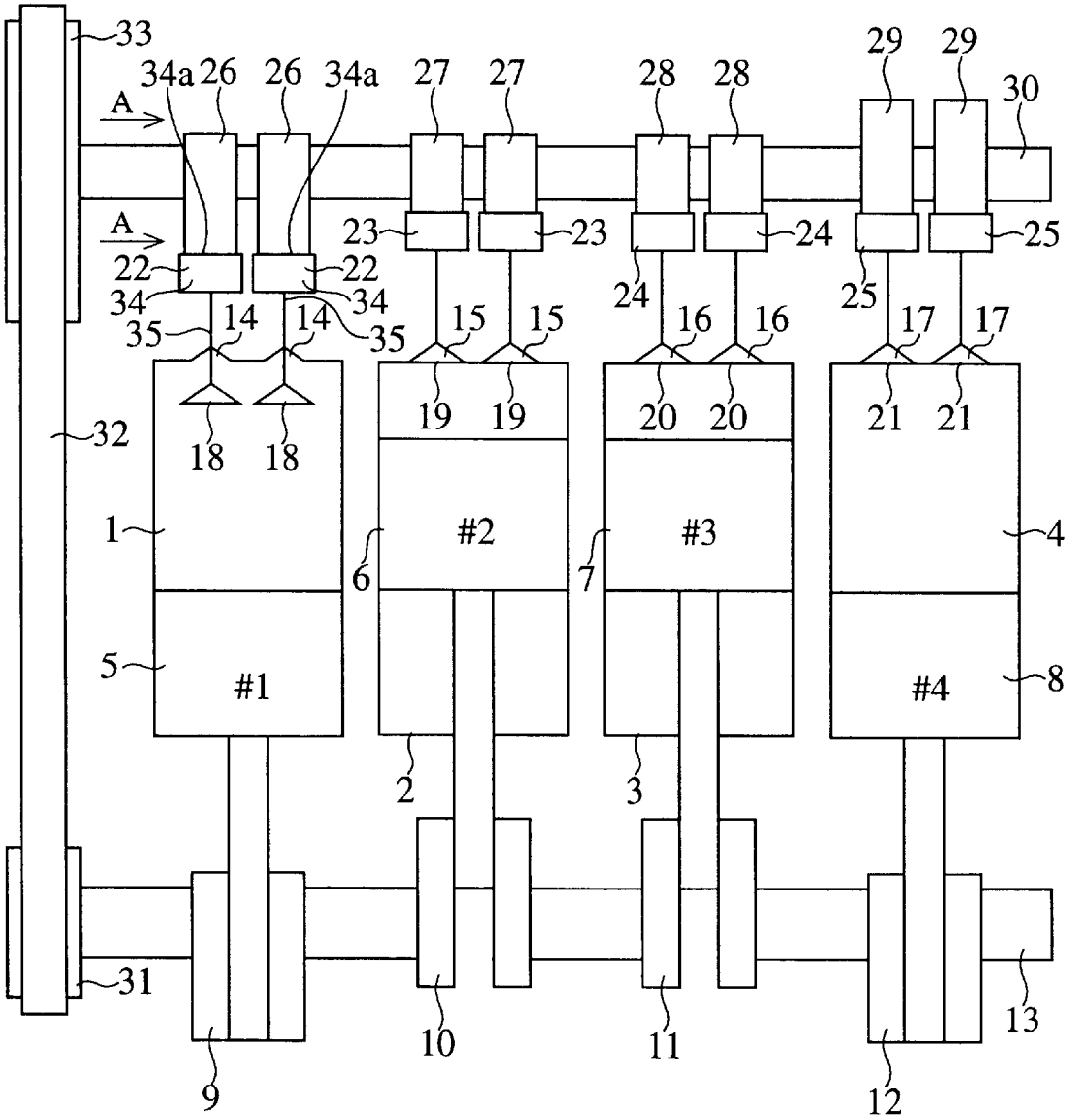
FIG. 1 (PRIOR ART)
FIG. 1 is a diagrammatic sketch of direct drive-style valve driving system in the engine.
Figure 2:
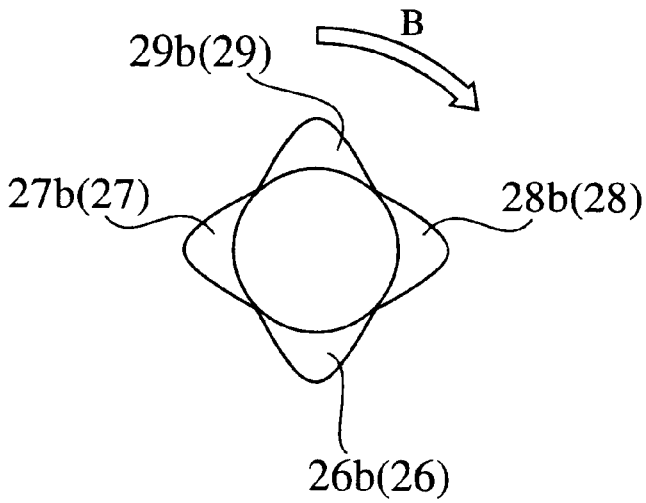
FIG.2 (PRIOR ART)
FIG. 2 is a view taken in the direction of arrow A—A in FIG. 1 and showing a cam on a camshaft in the valve driving system.
Figure 3:
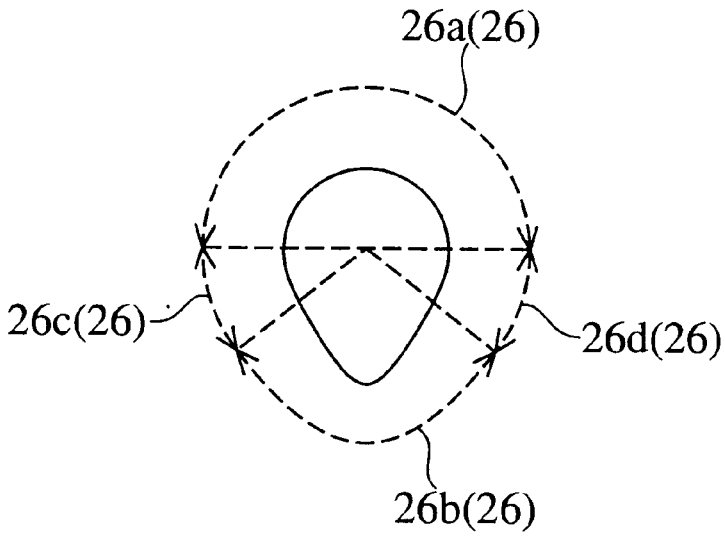
FIG.3 (PRIOR ART)
FIG. 3 is a front view of a cam-profile of a cam shown in FIG. 2.
Figure 4:
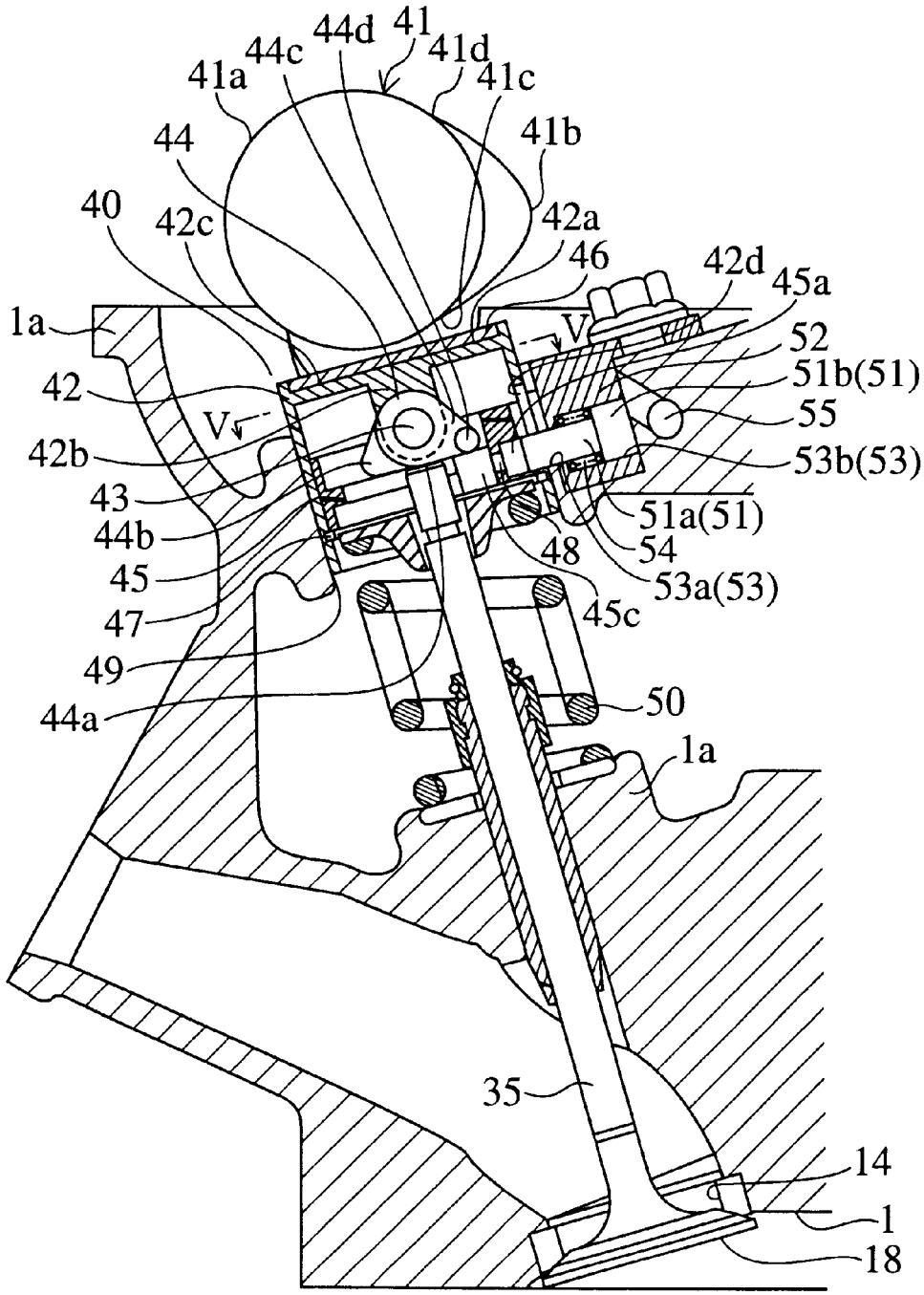
FIG. 4 is a longitudinal cross sectional view of an internal construction of a VVL device as embodiment 1 according to the present invention when the VVL device is located at a reference position.
Figure 5:
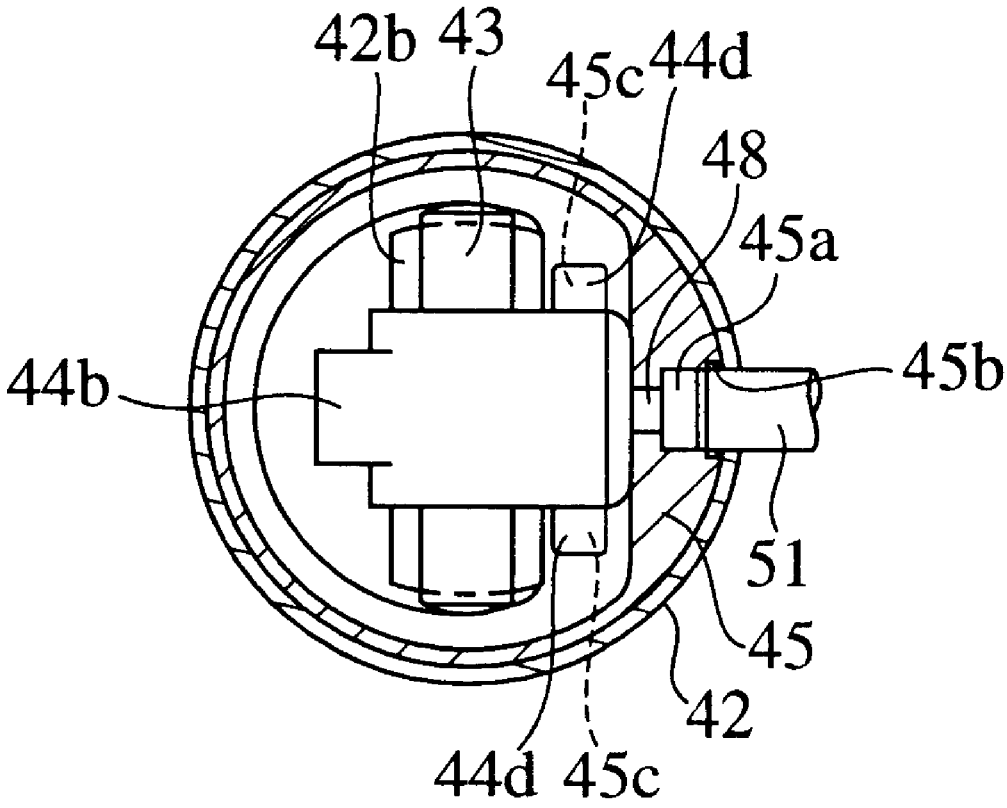
FIG. 5 is a cross sectional view taken along lines V—V of FIG. 4.
Figure 6:
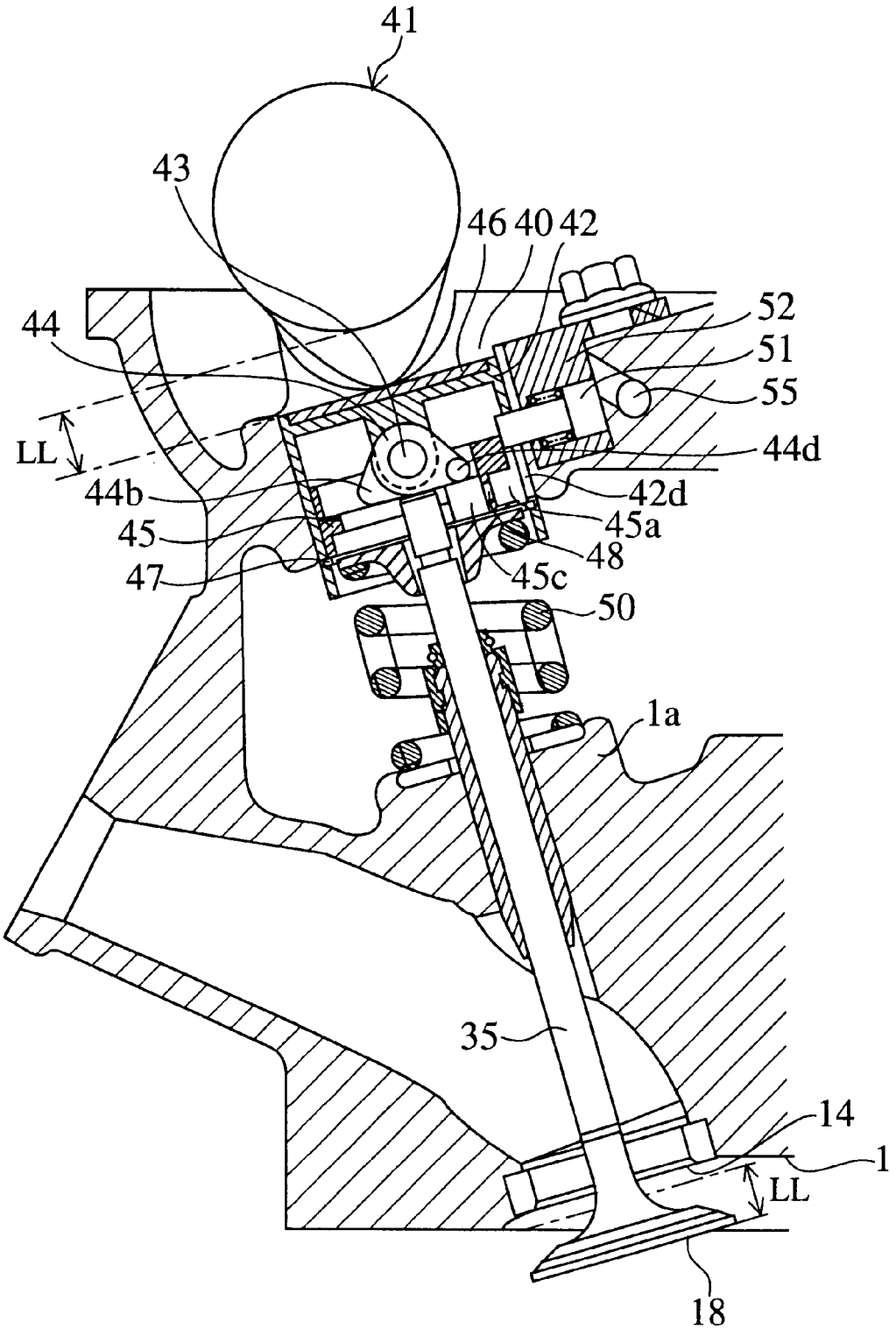
FIG. 6 is a longitudinal cross sectional view of the internal construction of the VVL device shown in FIG. 4 when the VVL device is set to the low-lift mode.
Figure 7:
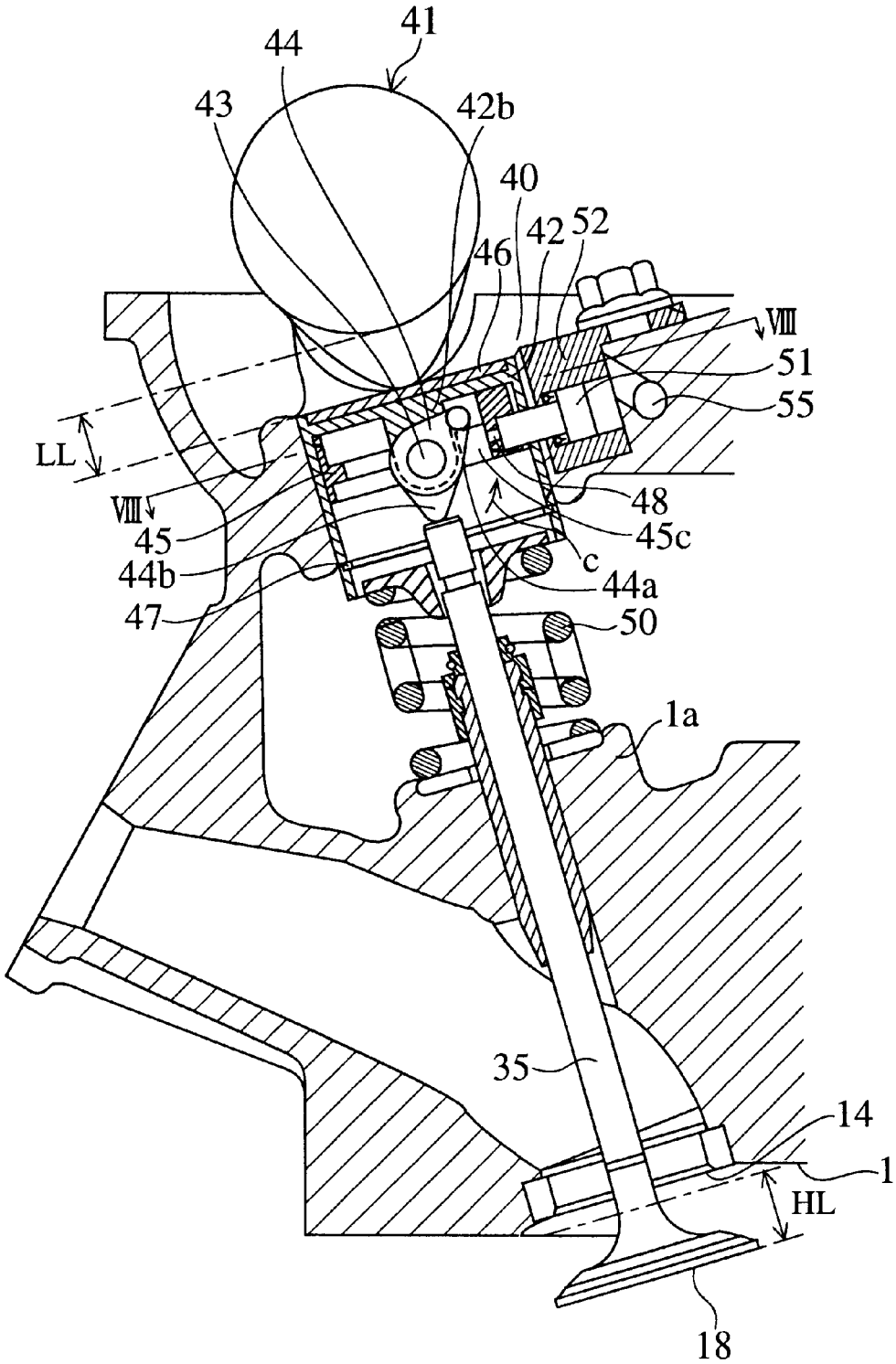
FIG. 7 is a longitudinal cross sectional view of the internal construction of the VVL device shown in FIG. 4 when the VVL device is set to the high-lift mode.
Figure 8:
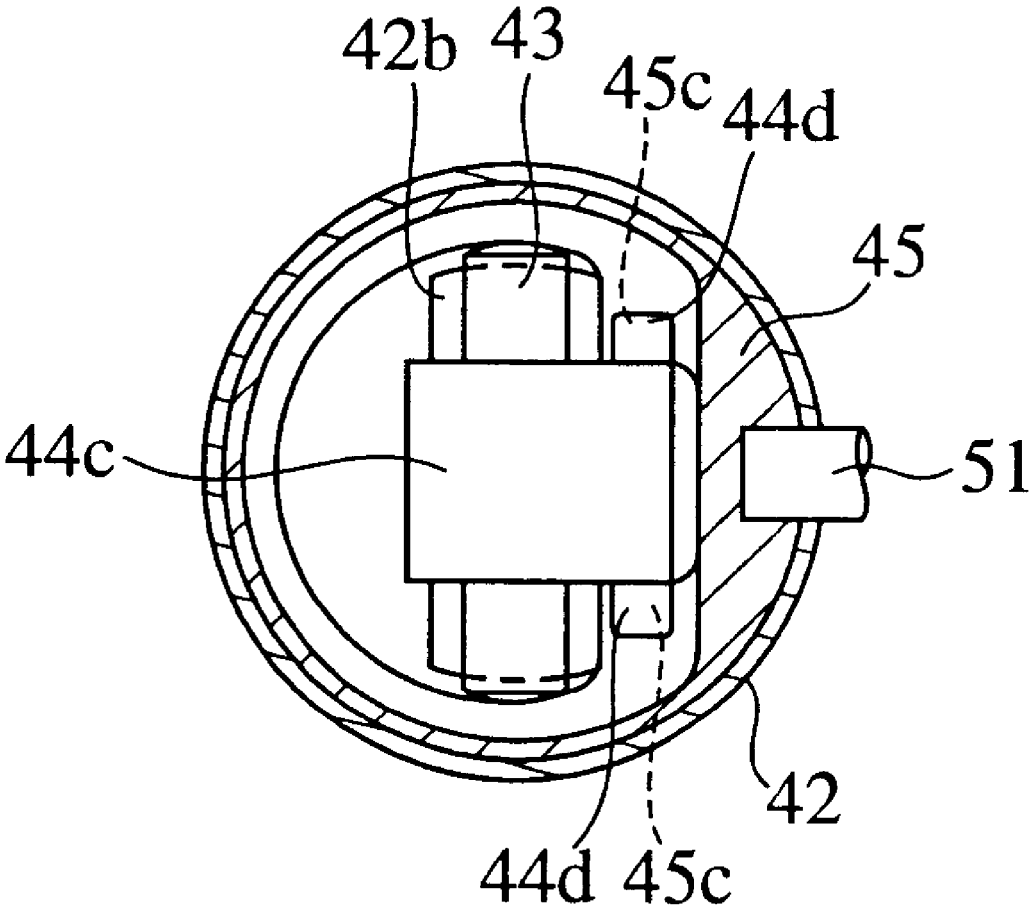
FIG. 8 is a cross sectional view taken along lines VIII—VIII of FIG. 7.

FIG. 4 is a longitudinal cross sectional view of an internal construction of a VVL device as embodiment 1 according to the present invention when the VVL device is located at a reference position. FIG. 5 is a cross sectional view taken along lines V—V of FIG. 4. FIG. 6 is a longitudinal cross sectional view of the internal construction of the VVL device shown in FIG. 4 when the VVL device is set to the low-lift mode. FIG. 7 is a longitudinal cross sectional view of the internal construction of the VVL device shown in FIG. 4 when the VVL device is set to the high-lift mode. FIG. 8 is a cross sectional view taken along lines VIII—VIII of FIG. 7. Since both of the intake side VVL device and the exhaust side VVL device have the same construction, both devices are operated by the same action. Here, Only the intake side VVL device is explained and the explanation of the exhaust side VVL device will be omitted. Moreover, it is assumed that a cylinder shown in the drawing is arranged in a vertical direction. Components of the embodiment 1 common to those of the conventional VVL device are denoted by the same reference numerals and further description will be omitted.

A VVL device 40 in the embodiment 1 is used together with an intake cam 41. The intake cam 41 includes a base circle section 41*a*, a lift-curved section 41*b*, two ramp sections 41*c* and 41*d* which constitute a low-lift cam profile adequate for either one or both of driving condition of middle speed or less and middle load or less of the engine. The VVL device 40 includes a bottom-equipped and cylindrical-shaped tappet case 42 having an upper end face functioned as a cam contact section 42*a* making contact with a cam face of the intake cam 41, an arm (sway member) 44 supported on a support section 42*b* extended downwardly from an upper bottom in the tappet case 42 to allow the sway itself about a main pin (sway axis) 43, and an inner ring (sliding member) 45 arranged to allow the slide-action itself in the tappet case 42. Moreover, the main pin 43 is so arranged as to be in parallel to a camshaft (not shown) of the engine.

A disk-shaped recess 42*c* is formed at an upper face of the upper bottom of the tappet case 42. A shim (clearance adjustment member) 46 is arranged in the recess 42*c* and adjusts a clearance defined between the base circle section 41*a* of the intake cam 41 and the upper section of the tappet case 42 as appropriate in consideration of thermal expansion and so on. With the embodiment 1, the cam contact section 42*a* is comprised of the shim 46 arranged in the recess 42*c*.

A long aperture 42*d* is formed at an outer peripheral face of the tappet case 42 and extends in an axial direction of the tappet case 42. A width of the long aperture 42*d* in a peripheral direction of the tappet case 42 is formed to be slightly larger than an outer diameter of an external piston described later. A length of the long aperture 42*d* in the axial direction of the tappet case 42 is so formed that the range of motion of the external piston described later is comparable to a difference between an axial displacement of the valve stem 35 in the low-lift mode and an axial displacement of the valve stem 35 in the high-lift mode. A stopper ring (ring-shaped member) 47 is arranged in an inner peripheral face of the tappet case 42 and restricts the downward sliding of the inner ring 45.

The arm 44 is an approximately cylindrical solid member. A base section 44*a* is formed at an outer peripheral face of the arm 44 and makes contact with the upper section of the valve stem 35 in the low-lift mode. A lift section 44*b* is formed at the outer peripheral face of the arm 44 and is projected outwardly in a radial direction of the arm 44. The lift section 44*b* makes contact with the upper section of the valve stem 35 in the high-lift mode to displace the valve stem 35 in the axial direction in a required range. The base section 44*a* and the lift section 44*b* both have a plane face corresponding to the upper plane face of the valve stem 35. A smooth, continuous face (sliding face) is so formed as to link the base section 44*a* to the lift section 44*b*. Of the outer peripheral face of the arm 44, a protuberance section 44*c* is formed at a position deviated from the base section 44*a* and the lift section 44*b* intheperipheral direction and is projected outwardly from the base section 44*a* in the radial direction. A rod section 44*d* is formed at a crest of the protuberance section 44*c* and extends in the axial direction of the arm 44.

The inner ring 45 is an approximately cylindrical member. A fit hole 45*a* is formed inwardly at an outer peripheral face of the inner ring 45 in a radial direction of the inner ring 45 and allows the insertion of the external piston described later. A drain hole 48 is formed at the back of the fit hole 45*a* and communicates between the fit hole 45*a* and an inner space of the inner ring 45 to discharge air, oil and so on to outside when the external piston is fitted into the fit hole 45*a*. A long groove 45*b* having a depth shallower than the fit hole 45*a* is formed at a position, which is close to the cam as compared with the fit hole 45*a*, of the outer peripheral face of the inner ring 45 to extend in the axial direction. Moreover, a pair of support sections 45*c* are arranged at an inner peripheral face of the inner ring 45 and supports upwardly both ends of the rod 44*d* of the arm 44.

Such a VVL device 40 is accommodated in an accommodation hole 49 arranged at the cylinder head 1*a* of the cylinder 1 to allow the sliding itself therein in the axial direction. A valve spring 50 is arranged between the upper section of the valve stem 35 and the cylinder head 1*a* and biases upwardly the valve stem 35 at all times to press the intake valve 18 against the valve seat 14 to close it.

A hydraulic system 52 is arranged at an inner peripheral section of the accommodation hole 49 of the cylinder head 1*a* and moves reciprocally an external piston 51 in the radial direction of the accommodation hole 49. The external piston 51 includes a frontal, minor diameter section 51*a* fitting into the fit hole 45*a* of the inner ring 45 and a rear, major diameter section 51*b* having a major diameter larger than the frontal, minor diameter section 51*a*. The external piston 51 is accommodated in a piston-accommodation hole 53 of the hydraulic system 52 to allow the sliding itself therein. The piston-accommodation hole 53 includes an opening section 53*a* having an inner diameter corresponding to the outer diameter of the frontal, minor diameter section 51*a* and an accommodation section 53*b* having an inner diameter corresponding to the outer diameter of the rear, major diameter section 51*b*. A coil spring 54 is arranged between a front end face of the accommodation section 53*b* and the rear, major diameter section 51*b* of the external piston 51 and biases rearward the external piston 51. An oil path 55 is arranged at a rear section of the piston-accommodation hole 53 and supplies a hydraulic pressure derived from an oil pump (not shown) to the piston-accommodation hole 53.

Here, a front end of the frontal, minor diameter section 51*a* of the external piston 51 is so set as to be inserted into the long groove 45*b* of the inner ring 45 via the long aperture 42*d* of the tappet case 42 due to a biasing force of the coil spring 54 when the external piston 51 moves back toward the most retarded position in a state of not providing a supply of hydraulic pressure to the hydraulic system 52. The setting serves the purpose of controlling a rotation of the inner ring 45 in the peripheral direction without controlling the axial displacement of the inner ring 45 due to the external piston 51 in a state of not providing a supply of hydraulic pressure to the hydraulic system 52. In this way, when the hydraulic pressure is supplied to the hydraulic system 52, it is possible to fit immediately the external piston 51 in the fit hole 45*a* of the inner ring 45. Moreover, since the external piston 51 is so set as to be inserted into the long aperture 42*d* of the tappet case 42 at all times, it is possible to control a rotation of the tappet case 42 in the peripheral direction. Therefore, it is possible to locate the tappet case 42 with respect to the external piston 51. In this way, since it is possible to keep the parallel relationship between the main pin 43 and the camshaft (not shown) of the engine, it is possible to match a sway direction of the arm 44 with a rotational direction of the intake cam 41. Therefore, it is possible to prevent the occurrence of a pinch.

High-strength (high-shearing stress), sintered materials or materials for exhibiting abrasion and sliding resistance properties such as a SCM and so on are used preferably as materials constituting at least one of the arm 44, the inner ring 45 and the external piston 45.

An operation of the VVL device 40 will be explained hereafter.

Initially, with either one or both of driving condition (low-lift mode) of middle speed or less and middle load or less of the internal combustion engine, the hydraulic pressure derived from the oil pump (not shown) is not supplied to the hydraulic system 52. Therefore, the external piston 51 stops at the most retarded position due to the biasing force of the coil spring 54 and the front end of the external piston 51 is not fit in the fit hole 45*a* of the inner ring 45. In other words, the inner ring 45 is not locked into the cylinder head 1*a* side because a locking operation of the external piston 51 is not worked in the axial direction. On the other hand, the base section 44*a* of the arm 44 makes contact with the upper section of the valve stem 35. The contact is kept substantially due to load derived from the valve stem 35 on the basis of the biasing force of the valve spring 50. Here, when the cam face of the intake cam 41 is sliding on the upper section of the tappet case 42 of the VVL device 40, the cam presses downwardly against the valve stem 35 through the base section 44*a* of the arm 44 in accordance with the cam profile. At the same time, the VVL device 40 comes down without changing the axial length of the tappet case 42. At this time, the axial displacements of the tappet case 42 and the intake valve 18 performed by the intake cam 41 are identical to each other and are comparable to a low-lift length (hereafter, referred as a LL) as shown in FIG. 6.

Next, with either one or both of driving condition (high-lift mode) of middle speed or more and middle load or more of the internal combustion engine, the hydraulic pressure derived from the oil pump (not shown) is supplied to the hydraulic system 52. Therefore, the external piston 51 keeps stopping at the most advanced position due to the supplied hydraulic pressure against the biasing force of the coil spring 54. The front end of the external piston 51 fits in the fit hole 45*a* of the inner ring 45. In other words, the inner ring 45 is locked into the cylinder head 1*a* side because the locking operation of the external piston 51 is worked in the axial and peripheral directions. On the other hand, the base section 44*a* of the arm 44 makes contact with the upper section of the valve stem 35. The contact is kept substantially due to load derived from the valve stem 35 on the basis of the biasing force of the valve spring 50. Here, when the cam face of the intake cam 41 is sliding on the upper section of the tappet case 42 of the VVL device 40, the tappet case 42 comes down together with the arm 44. Since the axial displacement of the inner ring 45 is however controlled due to the external piston 51, the inner ring 45 does not come down. At this time, the rod 44*d* of the arm 44 is lifted by the support section 45*c* of the inner ring 45 against the biasing force of the valve spring 50, and the arm 44 rotates about the main pin 43 in a direction of arrow C of FIG. 7. In this way, the base section 44*a* to the lift section 44*b* of the arm 44 slides on the valve stem 35. A different between a distance from a center of the main pin 43 to the base section 44*a* and a distance from the center of the main pin 43 to the lift section 44*b* is comparable to a different between lifts in the low-lift and the high-lift cam profiles. The axial length of the tappet case 42 lengthens by the difference. Moreover, the axial displacement of the tappet case 42 performed by the intake cam 41 is identical to the LL as in the case of the low-lift mode, and that of the intake valve 18 is comparable to a high-lift length (hereafter, referred as a HL) of FIG. 7.

Next, when returning to the low-lift mode, the external piston 51 returns to the most retarded position due to the biasing force of the coil spring 54 because the supply of the hydraulic pressure from the oil pump (not shown) to the hydraulic system 52 is stopped. At the same time, the front end of the external piston 51 is released from the fit hole 45*a* of the inner ring 45 to unlock the locking relation. In this way, the inner ring 45 allows the downwardly sliding in the tappet case 42 in the axial direction. The arm 44 therefore rotates in a direction opposite to the direction of arrow C due to the biasing force of the valve spring 50 while the lift section 44*b* to the base section 44*a* of the arm 44 is sliding on the valve stem 35. The axial length of the tappet case 42 returns to a previous one due to the rotation of the arm 44.

As described above, with the embodiment 1, the VVL device provides with the tappet case 42 which makes contact with the intake cam 41 and which is driven reciprocally due to the rotation of the intake cam 1, the arm 44 which is so supported in the tappet case 42 as to allow the sway of the arm 44 and which has the sliding face displacing the valve stem 35 in the axial direction of the valve stem 35, and the inner ring 45 which is so arranged in the tappet case 42 as to allow the sliding of the inner ring 45 and which sways the arm 44 when the inner ring 45 is slid. In this way, since it is possible to simplify the internal structure of the tappet case 42, the VVL device can be reduced in size and weight. Therefore, it is possible to make full use of the reduction of inertial mass defined as the maximum merit of the direct drive-style VVL device. When the engine runs at a high speed, the inner ring 45 is coupled to the cylinder head. At this time, the reduction of inertial mass is further expected.

With the embodiment 1, the intake cam 41 making contact with the tappet case 42 provides a low-lift cam profile adequate for either one or both of driving condition of middle speed or less and middle load or less of the internal combustion engine. In this way, since the construction is applicable to a camshaft equal to a camshaft used in a normal internal combustion engine without any specialized equipment, the VVL device 40 can be reduced in size and weight. Since the VVL device 40 per se is not operated under the above condition, it is possible to increase the durability and the reliability of the VVL device 40.

With the embodiment 1, the arm 44 is so set as to increase displacement of the intake valve 18 with respect to displacement of the tappet case 42 in the axial direction under the driving condition of middle speed or more and middle load or more of the internal combustion engine. In this way, only when the engine is driven under the above condition, it is possible to operate the arm 44 as a second cam to increase the valve lift. Therefore, it is possible to increase the durability and the reliability of the VVL device 40.

With the embodiment 1, the inner ring 45 provides with the fit hole 45*a* which allows the fit of the external piston 51 reciprocated based on the cylinder head 1*a* side of the internal combustion engine via the long aperture 42*d* extending on the outer peripheral face of the tappet case 42 in the axial direction of the tappet case 42, and the support section 45*c* supporting the protuberance 44*c* formed at a position different from a position of the lift section 44*b* of the arm 44 which makes contact with the valve stem 35 relative to the main pin 43 as the center of rotation of the arm 44 in a state of fitting the external piston 51 in the fit hole 45*a*. In this way, the tappet case 42 moves toward the intake valve 18 side in accordance with the cam profile when the external piston 51 is fitted in the fit hole 45*a* of the inner ring 45, whereas the movement of the inner ring 45 in the axial direction is restricted. Since the arm 44 moving together with the tappet case 42 sways due to the support section 45*c*, the contact section of the arm 44 slides on the valve stem 35. Therefore, it is possible to displace largely the valve stem 35 toward the intake valve 18 side in accordance with the profile of the contact section of the arm 44.

With the embodiment 1, the sliding face of the arm 44 making contact with the valve stem 35 has an advantageous shape for exhibiting the same abrasion and sliding resistance properties as the cam profile. In this way, since it is possible to prevent the occurrence of an abrasion and a pinch of the arm 44, it is possible to increase the durability and the reliability of the VVL device 40.

With the embodiment 1, the arm 44 provides with the sliding face having a shape adequate for locking the inner ring 45 due to a load derived from the valve stem 35 in a state of not fitting the external piston 51 in the fit hole 45*a* of the inner ring 45. In this way, since it is possible to prevent the occurrence of an abrasion and a pinch of the arm 44, it is possible to increase the durability and the reliability of the VVL device 40.

With the embodiment 1, the arm 44, the inner ring 45 and the external piston 51 are made of high-strength sintered materials or materials for exhibiting abrasion and sliding resistance properties. In this way, since it is possible to increase the durability of the VVL device 40 and to ensure the sliding resistance property between movable parts with stability over a long term, it is possible to increase the operational reliability of the VVL device 40.

With the embodiment 1, the external piston 51 moves forward to fit in the fit hole 45*a* of the inner ring 45 due to application of hydrodynamic pressure and moves back in a direction of unlocking the fit relation due to the biasing force of the coil spring 54 when the hydrodynamic pressure is not applied. In this way, since the external piston 51 is fitted detachably in the fit hole 45*a*, it is possible to increase the reliability of operation of the VVL device 40.

With the embodiment 1, the external piston 51 restricts the rotation of the tappet case 42 and the inner ring 45 in the peripheral direction and the displacement in the axial direction when the external piston 51 is fitted in the fit hole 45*a* of the inner ring 45. The external piston 51 further restricts the rotation of the tappet case 42 and the inner ring 45 in the peripheral direction when the fit relation is unlocked. In this way, since it is possible to locate the tappet case 42 and the inner ring 45 in the peripheral direction at all times, it is possible to increase the durability and the reliability of the VVL device 40.

With the embodiment 1, the long aperture 42*d* of the tappet case 42 has a width slightly larger than the outer diameter of the external piston 51. In this way, since the external piston 51 is fitted in the long aperture 42*d* to restrict the rotation of the tappet case 42 and to locate the tappet case 42 in the peripheral direction, it is possible to increase the durability and the reliability of the VVL device 40.

With the embodiment 1, the main pin 43 of the arm 44 is parallel to the camshaft. In this way, it is possible to reduce a pinch occurred between the arm 44 and the tappet case 42 and to increase the durability and the reliability of the VVL device 40.

With the embodiment 1, the inner ring 45 is a ring-shaped member, which is so arranged in the tappet case 42 as to slide between the uppermost section of the tappet case 42 and the stopper ring 47 fixed in the tappet case 42. In this way, the arm 44 making contact with the valve stem 35 can be arranged in the tappet case 42 and the inner ring 45. Therefore, since the respective parts can be arranged in such a compact space, the VVL device 40 per se can be reduced in size and weight.

With the embodiment 1, the drain hole 48 is arranged in the fit hole 45*a* of the inner ring 45. In this way, since it is possible to discharge lubricating oils and air remained in the fit hole 45*a* when the external piston 51 is fitted in the fit hole 45*a* of the inner ring 45, it is possible to improve responsibility of the external piston 51.

With the embodiment 1, the recess 42*c* is arranged at the upper section of the tappet case 42 to allow arrangement of the shim 46 adjusting a clearance defined between the base circle section 41*a* of the intake cam 41 and the upper section of the tappet case 42. In this way, when the internal combustion engine is assembled and fabricated, the shim 46 having a thickness corresponding to a measured value of the clearance can be arranged as appropriate. The support section 42*b* defined as a bearing of the main pin 43 of the arm 44 is arranged integrally in the tappet case 42. In this way, it is possible to reduce a component count to make an assembling work more efficient and to reduce the cost of parts.

Embodiment 2

Figure 9:
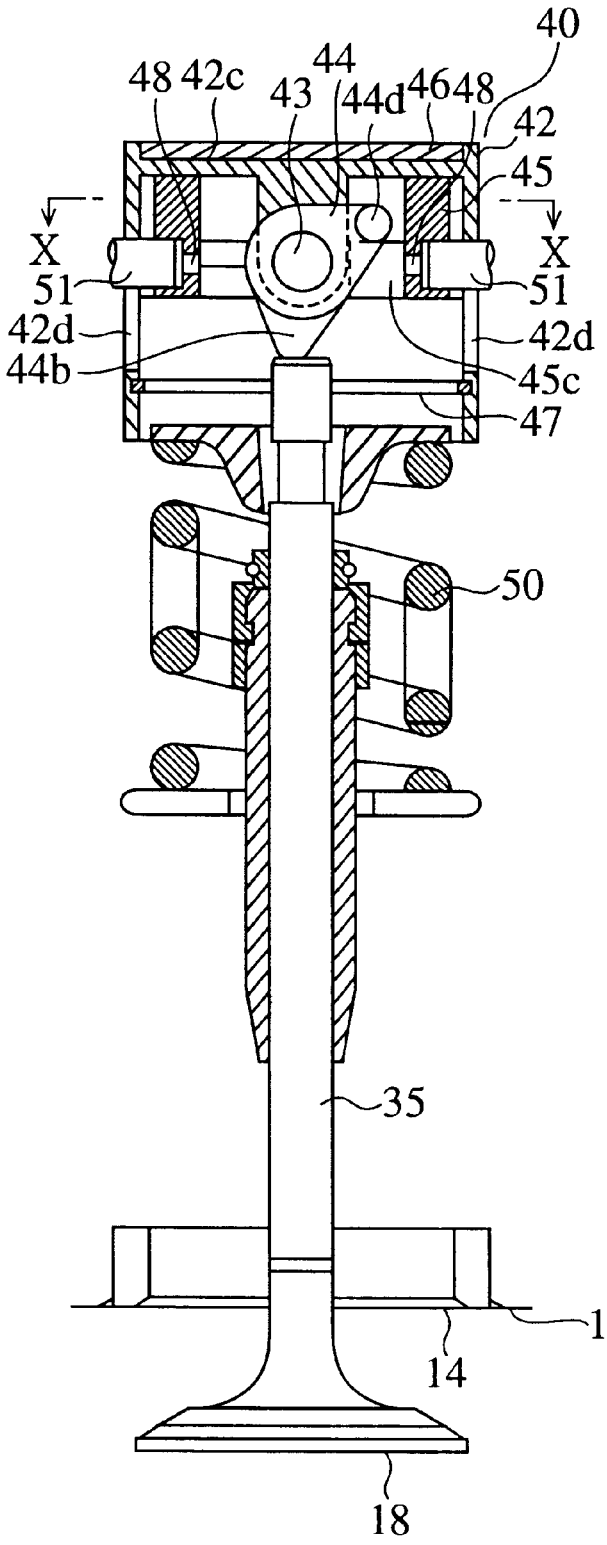
FIG. 9 is a longitudinal cross sectional view of an internal construction of a VVL device as embodiment 2 according to the present invention.
Figure 10:
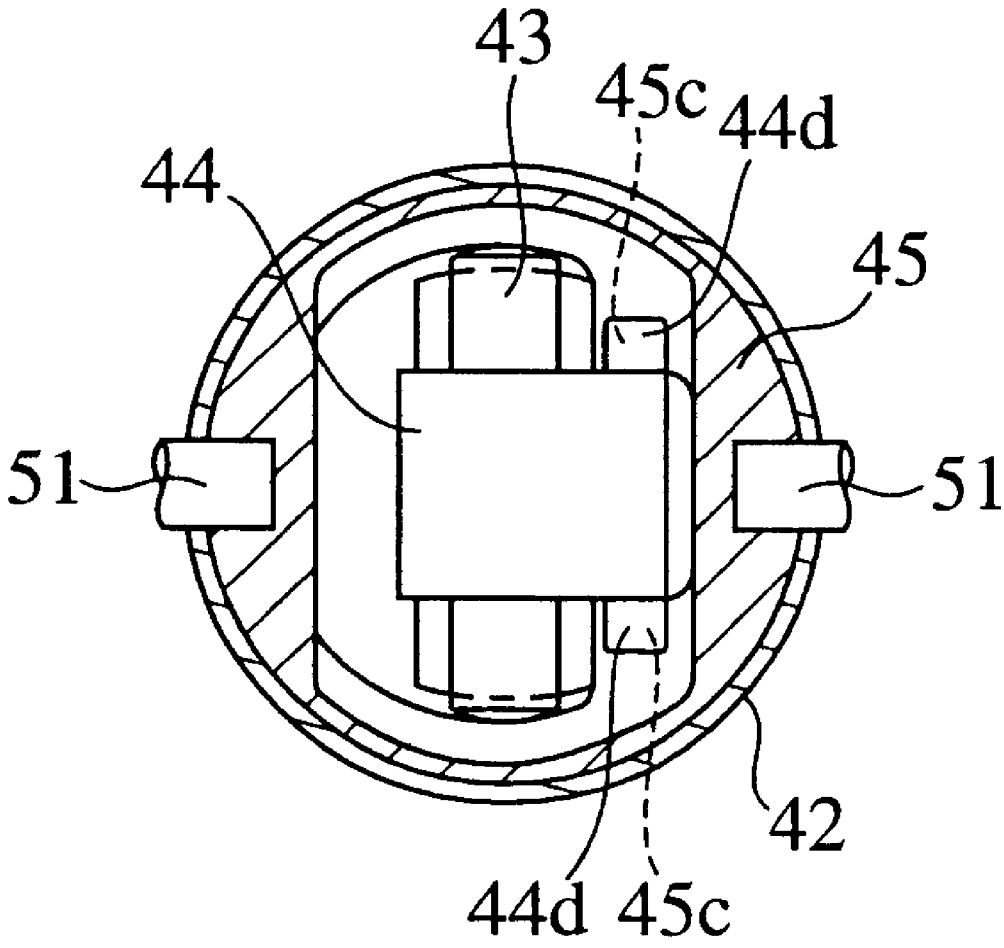
FIG. 10 is a cross sectional view taken along lines X—X of FIG. 9.
Figure 11:
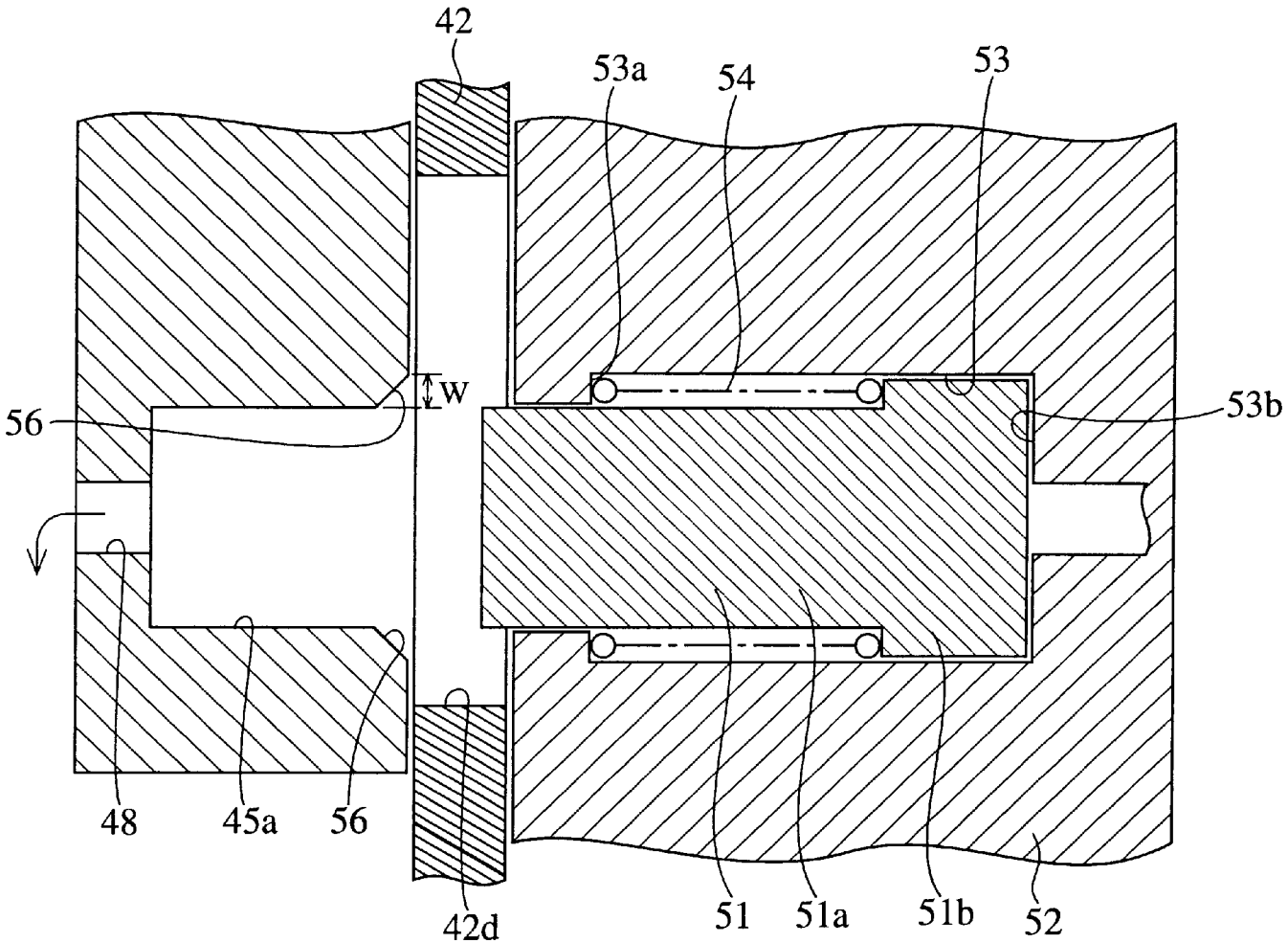
FIG. 11 is an enlarged, longitudinal cross sectional view of a fit hole in FIG. 9.

FIG. 9 is a longitudinal cross sectional view of an internal construction of a VVL device as embodiment 2 according to the present invention. FIG. 10 is a cross sectional view taken along lines X—X of FIG. 9. FIG. 11 is an enlarged, longitudinal cross sectional view of a fit hole in FIG. 9. Components of the embodiment 2 common to those of the embodiment 1 are denoted by the same reference numerals and further description will be omitted.

The embodiment 2 is characterized in that two external pistons 51 facing to each other are so arranged reciprocally as to be symmetrical with respect to the central axis of the tappet case 42. Therefore, two fit holes 45*a*, which are symmetrical to each other, are arranged as to correspond to the two external pistons 51.

With the embodiment 2, a tapered section 56 is formed at an opening of the each fit hole 45*a* of the inner ring 45. The tapered section 56 has a width W in the axial direction, the width being larger than a clearance defined between the base circle section 41*a* of the intake cam 41 and the upper section of the tappet case 42.

According to the embodiment 2, the two external pistons 51 facing to each other are so arranged reciprocally as to be symmetrical about the central axis of the tappet case 42. In this way, since it is possible to synchronize the two external pistons and to reduce a pinch occurred between the inner ring 45 and the tappet case 42 as compared to the use of one external piston 51. As a result, it is possible to increase the durability and the reliability of the VVL device 40.

According to the embodiment 2, the tapered section 56 is formed at an opening of the each fit hole 45*a* of the inner ring 45. The tapered section 56 has a width W in the axial direction, the width being larger than the clearance defined between the base circle section 41*a* of the intake cam 41 and the upper section of the tappet case 42. In this way, even if the axial displacement of the inner ring 45 with respect to the external piston 51 is comparable to the clearance above or so, it is possible to lead the external piston 51 to the fit hole 45*a* due to the tapered section 56. Therefore, it is possible to ensure the quick fitting of the external piston 51 in the fit hole 45*a* of the inner ring 45 with reliability and to improve the responsibility and the operational reliability.

Embodiment 3

Figure 12:
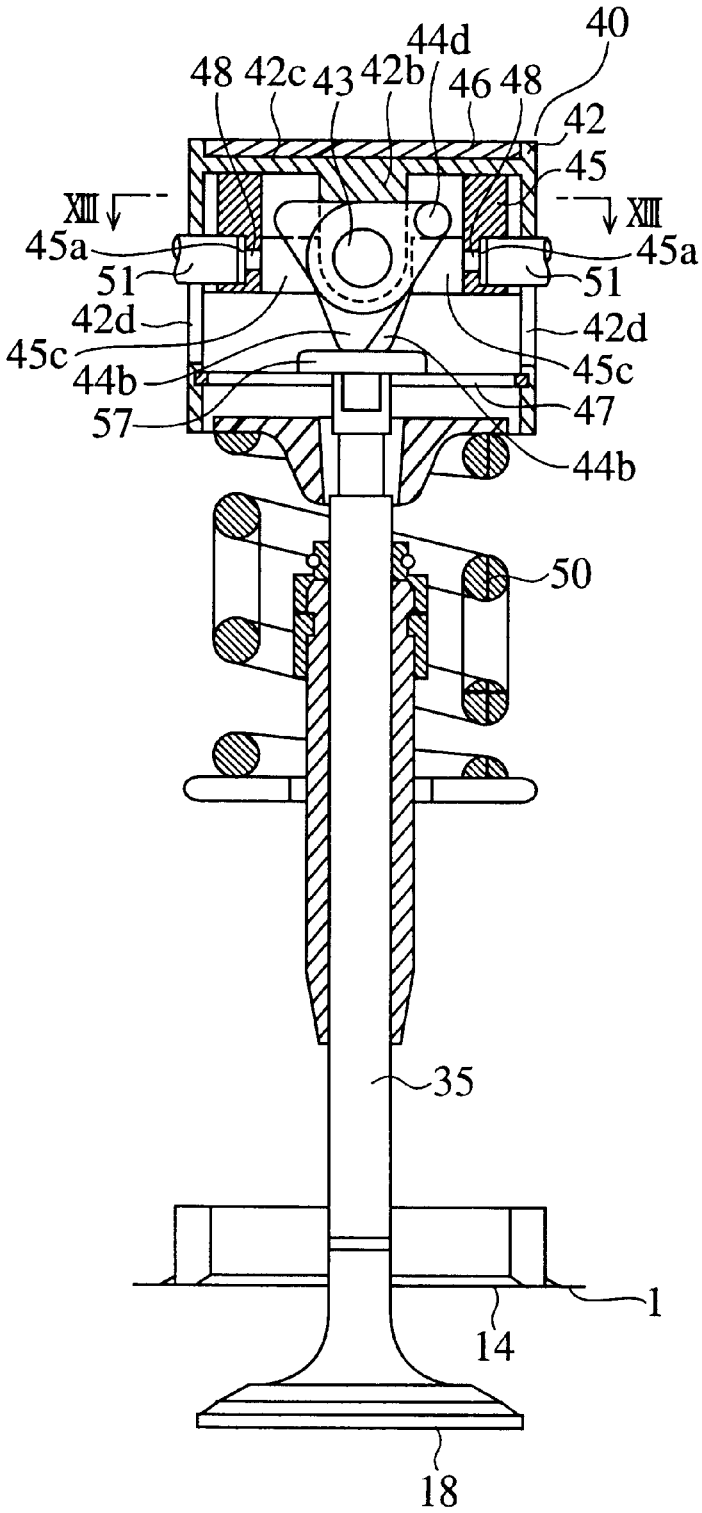
FIG. 12 is a longitudinal cross sectional view of an internal construction of a VVL device as embodiment 3 according to the present invention.
Figure 13:
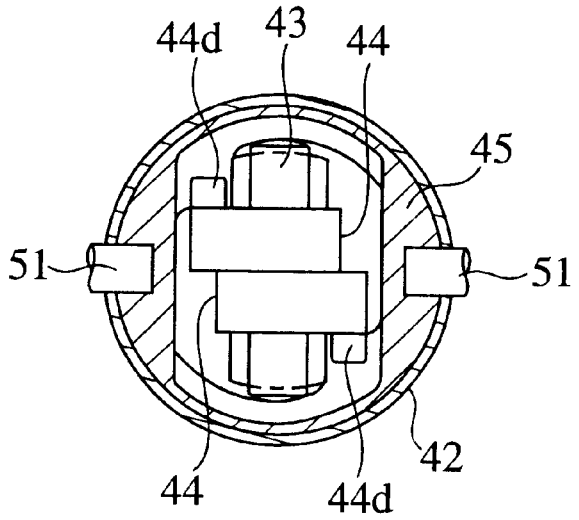
FIG. 13 is a cross sectional view taken along lines XIII—XIII of FIG. 12.

FIG. 12 is a longitudinal cross sectional view of an internal construction of a VVL device as embodiment 3 according to the present invention. FIG. 13 is a cross sectional view taken along lines XIII—XIII of FIG. 12. Components of the embodiment 3 common to those of the embodiment 1 and so on are denoted by the same reference numerals and further description will be omitted.

The embodiment 3 is characterized in that two arms 44, which are related as object and mirror image, are arranged at the main pin 43 in addition to arranging the two external pistons 51 facing to each other as to be symmetrical as in the case of the embodiment 2.

Moreover, an approximately disk-shaped shim (clearance adjustment member) 57 is arranged between the arm 44 and the valve stem 35. The shim 57 is a member which adjusts a clearance between the arm 44 and the valve stem 35 and which enlarges a contact face making contact with the arm 44.

According to the embodiment 3, two symmetrical arms 44 are arranged in one tappet case 42. In this way, it is possible to reduce a pinch occurred between the sway member and the tappet case and to increase the durability and the reliability of the VVL device 40. Moreover, the number of the arm 44 is not limited to the construction above provided that the arms are symmetrical to each other.

Figure 14:
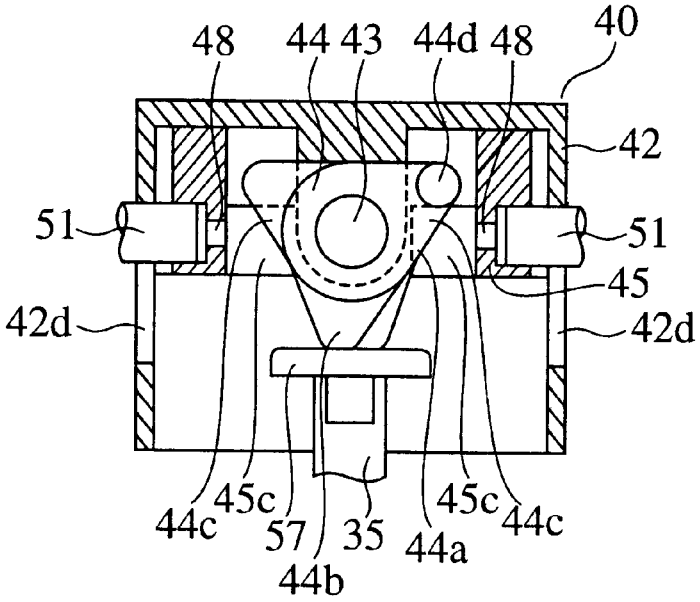
FIG. 14 is a longitudinal cross sectional view of an important point of an alternative of the VVL device as the embodiment 3.

FIG. 14 is a longitudinal cross sectional view of an important point of an alternative of the VVL device as the embodiment 3. With the alternative, the recess 42*c* is removed from the tappet case 42 and the residual section is formed as a plane face. The shim 57 is arranged at the upper section of the valve stem 35. The shim 57 has the function of adjusting a clearance between the intake cam 41 and the tappet case 42 in addition to adjusting the clearance between the arm 44 and the valve stem 35. In this way, it is possible to combine the clearance adjustment functions into one component and to reduce a component count. As a result, the VVL device can be reduced in weight.

Embodiment 4

Figure 15:
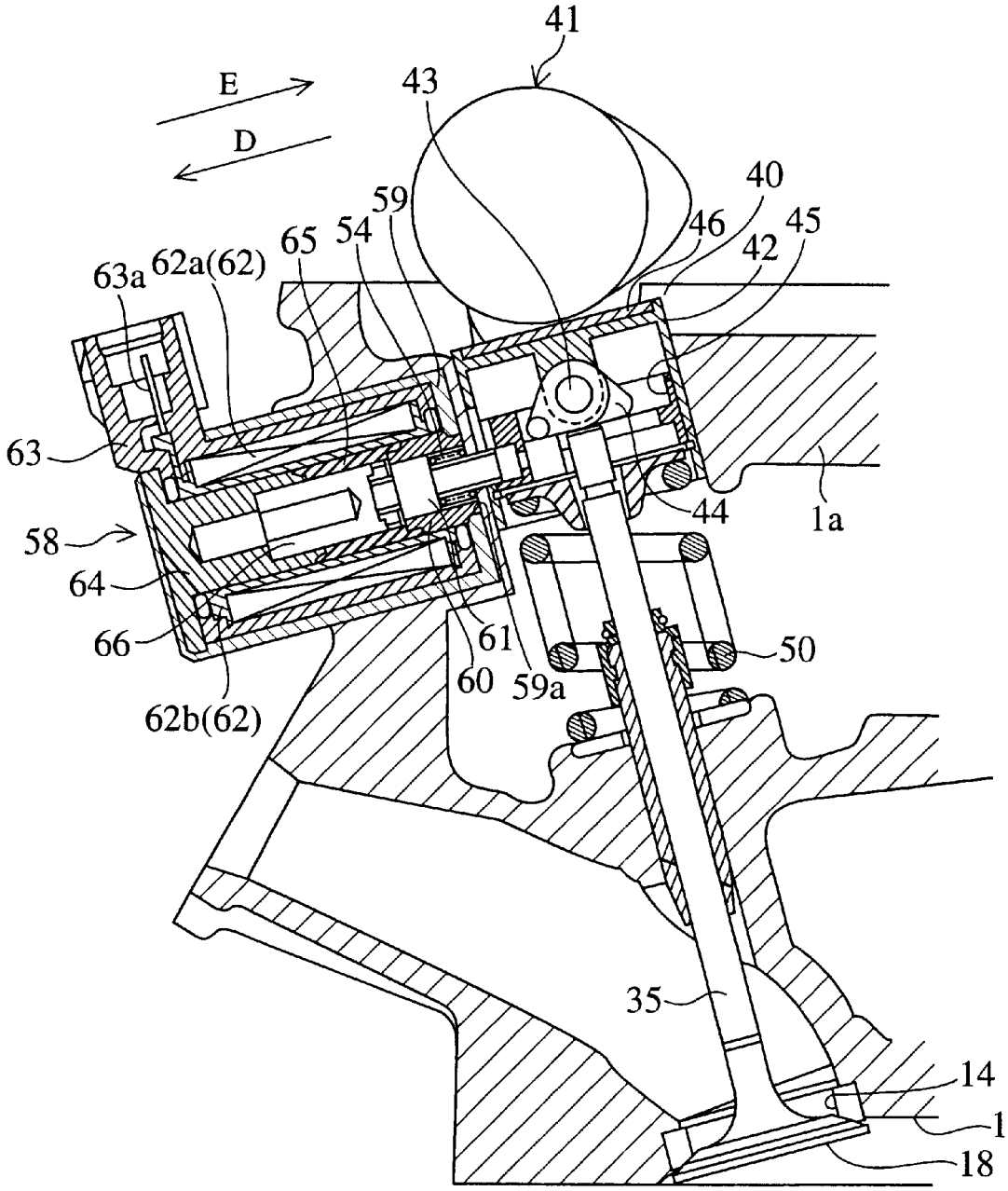
FIG. 15 is a longitudinal cross sectional view of an internal construction of a VVL device as embodiment 4 according to the present invention.

FIG. 15 is a longitudinal cross sectional view of an internal construction of a VVL device as embodiment 4 according to the present invention. Components of the embodiment 4 common to those of the embodiment 1 and so on are denoted by the same reference numerals and further description will be omitted.

The embodiment 4 is characterized in that an electromagnetic driving system 58 is used instead of the hydraulic system 52 as a system of driving the external piston 51. The electromagnetic driving system 58 includes a housing element 59 having an opening section 59*a* used for a reciprocal movement of the external piston 51, a boss 60 arranged in the opening section 59*a* of the housing element 59, a first sleeve 61 press-fitted in the boss 60 and supporting the external piston 51 in the axial direction to allow the sliding of the external piston 51, a coil spring 54 arranged between a front end of the first sleeve 61 and the cylinder head 1*a* via the opening section 59*a* of the housing element 59, a solenoid 62 arranged in the housing element 59 and having a coil 62*a* and a bobbin 62*b* supporting the coil 62*a*, a connector cover 63 providing with a terminal 63*a* connecting the solenoid 62 to an engine control unit (hereafter, referred as an ECU, not shown), a core 64 arranged in the bobbin 62*b* of the solenoid 62, a second sleeve 65 arranged between the core 64 and the bobbin 62*b*, and a plunger 66 defined as a moving core fixed at the inside of the second sleeve 65 and at the outer peripheral section of the external piston 51.

An operation will be explained hereafter.

Initially, with either one or both of driving condition (low-lift mode) of middle speed or less and middle load or less of the engine, control signals are transmitted from the ECU (not shown) to the solenoid 62. Therefore, the external piston 51 moves back in a direction of arrow D due to the biasing force of the coil spring 54. In this way, the inner ring 45 is not locked due to the external piston 45. It is possible to keep the base section 44*a* of the arm 44 in contact with the upper section of the valve stem 35 and to control the axial displacement of the valve stem 35 to the low-lift or LL.

Next, with either one or both of driving condition (high-lift mode) of middle speed or more and middle load or more of the engine, the solenoid 62 produces a electromagnetic force due to the control signals transmitted from the ECU (not shown). The plunger 66 moves forward in a direction of arrow E due to the electromagnetic force and the external piston 51 fixed at the plunger 66 moves forward against the biasing force of the coil spring 54. As a result, the external piston 51 is fitted in the fit hole 45*a* of the inner ring 45. In this way, since the inner ring 45 is locked due to the external piston 51, the arm 44 rotates due to the support section 45*c* of the inner ring 45. At this time, the base section 44*a* to the lift section 44*b* of the arm 44 is slid on the upper section of the valve stem 35. Therefore, it is possible to control the axial displacement of the valve stem 35 to the high-lift or HL.

As described above, according to the embodiment 4, the external piston 51 moves forward to fit in the fit hole 45*a* of the inner ring 45 due to application of the electromagnetic force. The external piston 51 further moves back in a direction of unlocking the fit relation due to the biasing force of the coil spring 54 when the electromagnetic force is not applied. In this way, since the external piston 51 is fitted detachably in the fit hole 45*a*, it is possible to increase the reliability of operation of the VVL device 40.

The present invention maybe embodied in other specific forms without departing from the spirit or essential characteristics thereof. The present embodiment is therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A variable valve lift device, comprising:

a tappet case which makes contact with one of cams arranged at a camshaft driven rotationally due to a crankshaft of an internal combustion engine and which is driven reciprocally due to the rotation of the cam;

a sway member which is so supported in the tappet case as to allow sway of the sway member and which has a sliding face displacing a valve stem in an axial direction of the valve stem; and a sliding member which is so arranged in the tappet case as to allow sliding of the sliding member and which sways the sway member when the sliding member is slid.

2. The variable valve lift device according to claim 1, wherein the tappet case comprises:

a recess formed at an upper face of the upper bottom of the tappet case; and a clearance adjustment member arranged in the recess for adjusting a clearance defined between a base circle of an intake cam and an upper section of the tappet case.

3. The variable valve lift device according to claim 1, wherein the tappet case comprises:

a long aperture formed at an upper peripheral face of the tappet case and extending in an axial direction of the tappet case; and a ring-shaped member arranged in an inner peripheral face of the tappet case and restricting a downward sliding of the inner ring.

4. The variable valve lift device according to claim 3, wherein the long aperture of the tappet case has a width slightly larger than an outer diameter of the external piston.

5. The variable valve lift device according to claim 1, wherein the sway member comprises:

a base section formed at an outer peripheral face of the sway member and making contact with an upper section of the valve stem; and a lift section formed at an outer peripheral face of the sway member and projecting outwardly from the base section in a radial direction; and wherein a smooth, continuous sliding face is so formed as to link the base section and the lift section.

6. The variable valve lift device according to claim 5, wherein a sliding face of the sliding member making contact with the valve stem has an advantageous shape for exhibiting the same abrasion and sliding resistance properties as the cam profile.

7. The variable valve lift device according to claim 1, wherein the sway member comprises:

a fit hole formed inwardly at an outer peripheral face of an inner ring in a radial direction of the inner ring;

a drain hole formed at the back of the fit hole and communicating between the fit hole and an inner space of the inner ring; and a support section arranged at an inner peripheral face of the inner ring and supporting upwardly both ends of a rod of the sway member.

8. The variable valve lift device according to claim 7, wherein the external piston moves forward to fit in the fit hole of the sliding member due to application of hydrodynamic pressure or electromagnetic force and moves back in a direction of unlocking the fit relation due to a mechanical biasing force when the hydrodynamic pressure or electromagnetic force is not applied.

9. The variable valve lift device according to claim 7, wherein the external piston restricts rotation of the tappet case and the sliding member in a peripheral direction thereof and displacement in the axial direction when the external piston is fitted in the fit hole of the sliding member and restricts the rotation of the tappet case and the sliding member in the peripheral direction thereof when the fit relation is unlocked.

10. The variable valve lift device according to claim 7, wherein the external piston is made of high-strength sintered materials or materials for exhibiting abrasion and sliding resistance properties.

11. The variable valve lift device according to claim 1, wherein the sway member is so set as to increase displacement of an intake valve or an exhaust valve with respect to displacement of the tappet case in the axial direction under a driving condition of middle speed or more and middle load or more of the internal combustion engine.

12. The variable valve lift device according to claim 1, wherein the cam making contact with the tappet case has a low-lift cam profile adequate for either one or both of a driving condition of middle speed or less and middle load or less of the internal combustion engine.

13. The variable valve lift device according to claim 1, wherein the sway member or the sliding member is made of high-strength sintered materials or materials for exhibiting abrasion and sliding resistance properties.

14. The variable valve lift device according to claim 1, wherein a central axis of swaying of the sway member is parallel to the camshaft.

15. A variable valve lift device, comprising:

a tappet case which makes contact with one of cams arranged at a camshaft driven rotationally due to a crankshaft of an internal combustion engine and which is driven reciprocally due to the rotation of the cam;

a sway member which is supported in the tappet case by a main pin and operable to rotate about a sway axis;

said sway member having a sliding force which displaces a valve stem in an axial direction of the valve stem when the sway member rotates about the sway axis; and a sliding member which is so arranged in the tappet case as to allow sliding of the sliding member and which rotates the sway member about the sway axis when the sliding member is slid.

* * * * *